US009113690B2

(12) United States Patent
Stubbs

(10) Patent No.: US 9,113,690 B2
(45) Date of Patent: Aug. 25, 2015

(54) HEATABLE HAIR ROLLERS

(71) Applicant: Judith Kay Stubbs, Littleton, CO (US)

(72) Inventor: Judith Kay Stubbs, Littleton, CO (US)

( * ) Notice: Subject to any disclaimer, the term of this patent is extended or adjusted under 35 U.S.C. 154(b) by 0 days.

(21) Appl. No.: 14/042,223

(22) Filed: Sep. 30, 2013

(65) Prior Publication Data

US 2015/0090286 A1 Apr. 2, 2015

(51) Int. Cl.
*A45D 2/12* (2006.01)

(52) U.S. Cl.
CPC ..... *A45D 2/12* (2013.01)

(58) Field of Classification Search
CPC ..... A45D 2/00; A45D 2/12; A45D 2/122; A45D 2/125; A45D 2/127; A45D 2/14
USPC ..... 132/223, 226, 233, 237, 242, 245, 248, 132/269
See application file for complete search history.

(56) References Cited

U.S. PATENT DOCUMENTS

| | | | | |
|---|---|---|---|---|
| 3,495,601 | A * | 2/1970 | Garrett | 132/237 |
| 4,267,851 | A | 5/1981 | Plaisted | |
| 4,526,184 | A * | 7/1985 | Caruso | 132/221 |
| 4,699,159 | A * | 10/1987 | Thaler | 132/226 |
| 4,881,559 | A * | 11/1989 | Kin | 132/226 |
| 5,285,800 | A * | 2/1994 | Powers-McCarthy | 132/210 |
| 5,526,829 | A * | 6/1996 | Smith | 132/229 |
| 7,296,580 | B1 | 11/2007 | Sbardella | |
| 2011/0114111 | A1* | 5/2011 | Guthans | 132/211 |
| 2013/0019891 | A1 | 1/2013 | Cheung et al. | |

FOREIGN PATENT DOCUMENTS

WO 2011015874 A1 2/2011

* cited by examiner

*Primary Examiner* — Rachel Steitz
(74) *Attorney, Agent, or Firm* — Dorsey & Whitney LLP

(57) ABSTRACT

A heatable hair roller includes a roller shell and a removable heatable rod. The unheated roller shell is secured in the hair without risk of heating or burning the skin. The heatable rod is then inserted into the roller shell, and the heatable rod heats the hair by heating the roller shell. An optional roller strap secures the roller shell to the hair. An optional expansion sleeve increases the effective diameter of the heatable rod. An optional heating unit heats the heatable rod.

28 Claims, 7 Drawing Sheets

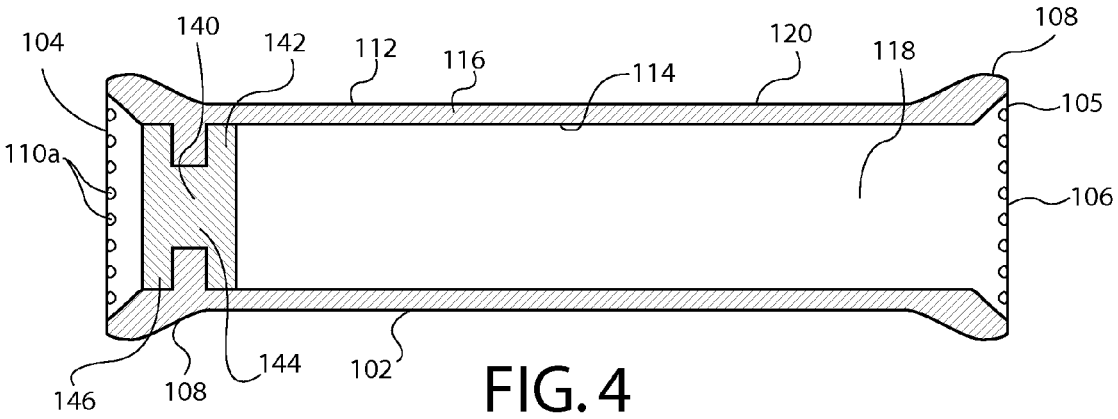
FIG. 4
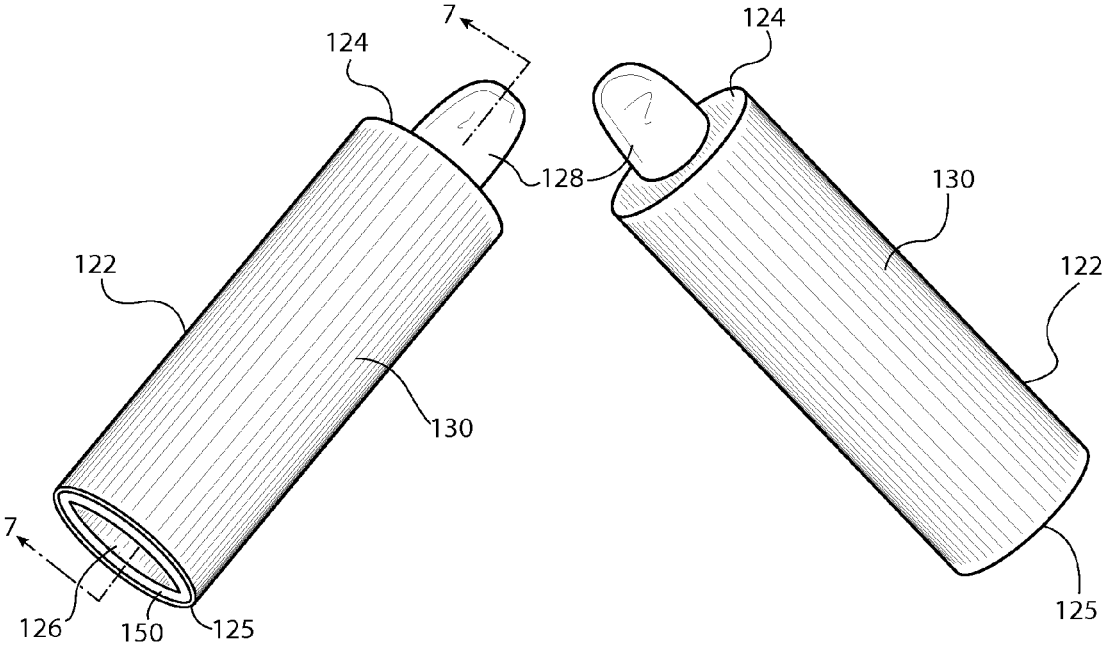
FIG. 5
FIG. 6

HEATABLE HAIR ROLLERS

TECHNICAL FIELD

The technology described herein relates to heatable hair rollers and methods of using the same.

BACKGROUND

Heated hair rollers create long-lasting curls, but the hot rollers are painful to the touch and therefore difficult, uncomfortable, and sometimes dangerous to use. Curling irons are more comfortable to hold, but users often accidentally burn themselves or others with hot irons, and the curls that irons create usually do not last as long as curls produced from heated hair rollers.

The information included in this Background section of the specification, including any references cited herein and any description or discussion thereof, is included for technical reference purposes only and is not to be regarded as subject matter by which the scope of the invention as defined in the claims is to be bound.

SUMMARY

The technology disclosed herein relates to heatable hair rollers. The heatable hair roller may be used to comfortably and safely create curled tresses. The heatable hair roller comprises a roller shell and a removable heatable rod. The roller shell is wound into the hair before the roller shell has been heated, which avoids discomfort, pain, and burning associated with touching hot rollers. The heatable rod fits into a cavity in the roller shell. An insulated grip on the heatable rod allows the user to safely and comfortably insert the heated heatable rod without burning the skin. A rod attachment in the roller shell secures the roller shell to the heatable rod. In some embodiments, the heatable rod comprises an opposing rod attachment that is compatible with the roller attachment and helps secure the roller shell to the heatable rod.

In some embodiments, a roller strap is provided with the roller shell and heatable rod. The roller strap secures the roller shell, with or without an inserted heatable rod, to a user's hair.

In some embodiments, a roller shell comprises a thermally conductive filler, which allows the outside diameter of the roller shell to be increased while the diameter of the roller shell cavity remains the same. One size of heatable rod can thus be used to heat roller shells with a variety of diameters.

In some embodiments, an expansion sleeve is provided with the roller shell and heatable rod. The expansion sleeve fits over a heatable rod and increases the effective outer diameter of the heatable rod. In some embodiments, one or both of the heatable rod and expansion sleeve comprise a sleeve attachment, which secures the expansion sleeve to the heatable rod. With an expansion sleeve, one size of heatable rod can be used to heat roller shells with a variety of diameters.

In some embodiments, a heating unit is provided with the roller shells and heatable rods. The heating unit comprises a plurality of posts that heat the heatable rods. The heating unit also comprises controls and function indicators that turn the heating unit on and off, select a temperature, and indicate when a selected temperature has been reached.

In one implementation, a method for using the heatable hair rollers, such as to curl hair, is provided. The roller shells are wound into the hair before they have been heated, which avoids discomfort, pain, and burning associated with touching hot rollers. Roller straps secure the roller shells to the hair. After the heatable rods have been heated on the posts of the heating unit, they are inserted into the roller shells and heat the roller shells. After the heatable rods and roller shells have cooled, both are removed from the hair, leaving curled tresses.

In another method for using the heatable hair rollers, the heatable rods are removed from the roller shells after partially or completely cooling, are re-heated in the heating unit, and are re-inserted in the roller shells, which have remained secured to the head. Longer-lasting curls are thereby produced. In another method, a reheated heatable rod is inserted into a roller shell that has not yet been heated. A number of roller shells greater than the number of heatable rods are thereby heated.

In another method for using the heatable hair rollers, an expansion sleeve is applied over the heatable rod before the heatable rods are heated. The expansion sleeve with heatable rod is used with larger diameters of roller shells, thereby creating bigger, looser curls than smaller diameters of roller shells.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. A more extensive presentation of features, details, utilities, and advantages of the present invention as defined in the claims is provided in the following written description of various embodiments of the invention and illustrated in the accompanying drawings.

BRIEF DESCRIPTION OF THE DRAWINGS

FIG. 4 is an elevation view in cross section taken along line 4 in FIG. 2.

FIG. 5 is a front isometric view of a heatable rod of the heatable hair roller of FIG. 1.

FIG. 6 is a rear isometric view of the heatable rod of FIG. 5.

DETAILED DESCRIPTION

Heatable hair rollers are disclosed herein. The heatable hair rollers may be generally understood as having roller shells with removable heatable rods. The roller shells are comfortably secured to human hair before the roller shells have been heated, without the risk of heating or burning the skin of the fingers, hands, head, face, or elsewhere. The heatable rods heat the roller shells by heat transfer. The heated roller shells in turn heat the hair to which they are secured, thereby forming a curl in the hair. The heatable rods are reliably secured to the roller shells, but are also easy to insert into and remove from the roller shells as desired.

In some implementations, roller straps that secure the roller shell to the user's hair are provided. In some implementations, expansion sleeves that increase the effective outer diameter of the heatable rods are provided to permit one size of heatable rod to be compatible with various sizes of roller shells. In some implementations, the heatable hair rollers are provided with a heating unit for heating the heatable rods.

FIGS. 1-7 depict one exemplary embodiment of a heatable hair roller 100. The heatable hair roller 100 comprises a heatable rod 122 releasably secured to a roller shell 102.

Figure 2:
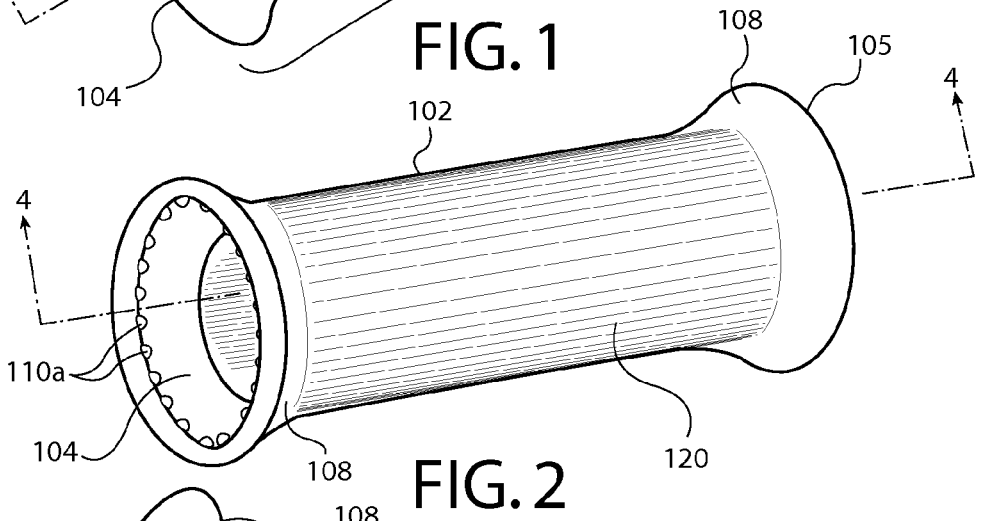
FIG. 2 is a front isometric view of a roller shell of the heatable hair roller of FIG. 1.
Figure 3:
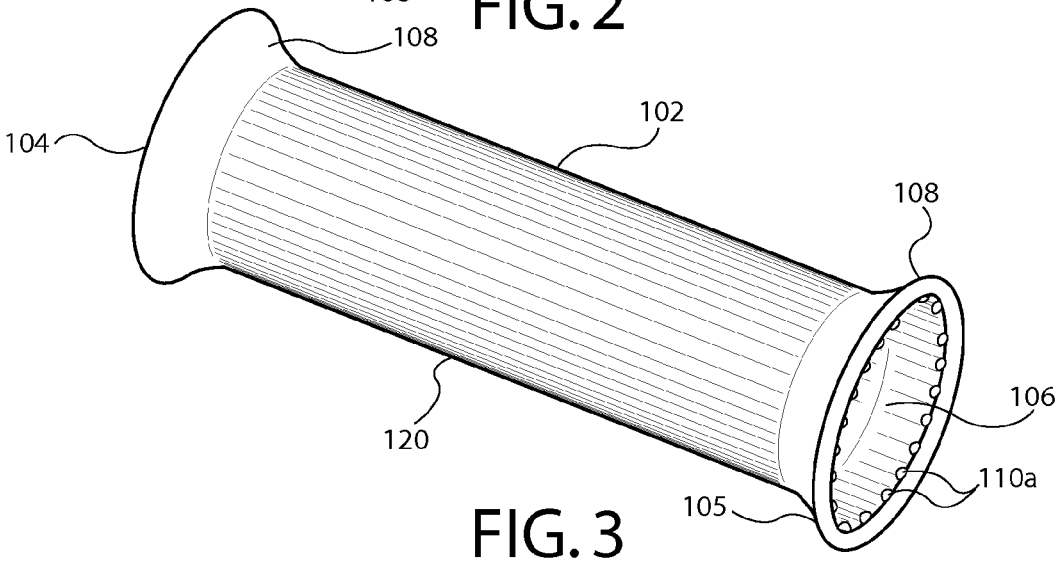
FIG. 3 is a rear isometric view of the roller shell of FIG. 2.

FIGS. 2 & 3 depict one exemplary embodiment of a roller shell 102. The roller shell 102 comprises a substantially cylindrical bobbin portion 120. In some embodiments, the outside of the bobbin portion 120 may be substantially smooth. In some embodiments, the outside of the bobbin portion 120 may be formed with bumps or ridges (not shown), which may help to hold the roller shell 102 in the user's hair. The bobbin portion 120 may have any outer diameter to provide different curl diameters. For example, the bobbin portion 120 may be 0.5 inch, 0.75 inch, 1.0 inch, 1.25 inches, 1.5 inches, 1.75 inches, 2.0 inches, 2.25 inches, 2.5 inches, 2.75 inches, or 3.0 inches in diameter.

One or both ends of the roller shell 102 may form a flange 108. The diameter of each flange 108 may be the same or different. The diameter of a flange 108 on one or both ends of the roller shell 102 may be greater than the diameter of the bobbin portion 120. The diameter of a flange 108 on one or both ends of the roller shell 102 may be sufficient to allow a user's fingers to grip or hold the flange(s) 108. The flange 108 may curve outward from the diameter of the bobbin portion 120 to the outer diameter of the flange 108. The flange 108 may further help hold the user's hair on the roller shell 102 and prevent it from sliding off the lateral ends thereof.

The flange 108 may comprise any number of teeth 110*a*. The teeth 110*a* may be substantially evenly spaced around the distal interior edge of the flange 108. The teeth 110*a* may be any size and shape know in the art including, but not limited to, substantially pyramidal or hemispherical. The teeth 110*a* may help secure the roller shell 102 to a roller strap 160, as described below.

One end of the roller shell 102 is a closed end 104. The other end of the roller shell 102 is an open end 105. The open end 105 comprises a roller opening 106. The roller opening 106 may be substantially circular. The roller opening 106 may be wide enough to accept a heatable rod 122. In some embodiments, the roller opening 106 is wide enough to accept an expansion sleeve 290, as described below.

In some embodiments, some or all of the bobbin portion 120, flange 108, teeth 110*a*, and closed end 104 are integrally molded to form the roller shell 102. In some embodiments, some or all of the bobbin portion 120, flange 108, teeth 110*a*, and closed end 104 are separate pieces secured together by any means know in the art, such as gluing or bonding.

FIG. 4 depicts a cross-section of the roller shell 102 according to one exemplary embodiment. The roller shell 102 may be made (e.g., by molding) of a thermally conductive material 116 with good heat transfer properties or it may be double-walled with a thermally conductive filler material in between. The roller shell 102 has an outer wall 112 and inner wall 114. Each wall 112, 114 may be any thickness. The outer wall 112 may define the exterior of at least the bobbin portion 120 of the roller shell 102. The outer wall 112 may also define the exterior of one or more flanges 108 of the roller shell 102. The inner wall 114 may extend the length of the inside of the bobbin portion 120. The inner wall 114 may also extend into the inside of one or more flanges 108. The inner wall 114 may extend to or along the inside of the closed end 104. The inner wall 114 may extend to the roller opening 106. The inner wall 114 may surround and define a roller cavity 118. The roller cavity 118 is configured to receive the heatable rod 122.

If double-walled, the outer wall 112 and inner wall 114 may define an annular space between the outer and inner walls 112, 114 that is filled with a heat conductive filler material. The thermally conductive material 116 or the combination of the outer wall 112, inner wall 114, and the filler material may be constructed of one or more known thermally conductive materials. For example, the thermally conductive material 116 may be boron nitride, silica, a metal, such as aluminum, a plastic, a polymer, an epoxy, or an elastomer, such as a thermoplastic elastomer or resin. A thermoplastic elastomer or resin may be, for example, a block copolymer, butadiene, ethylene propylene, isoprene, polystyrene, polyisoprene, polycarbonate, polypropylene, propylene, or any combination thereof. The thermally conductive material 116 or the combination of the outer wall 112, inner wall 114, and the filler material may also be constructed of any one or more known heat-retaining materials. The outer wall 112, inner wall 114, and filler material may be constructed of the same or different materials. For example, the outer wall 112 may be constructed of a plastic and the filler material may be constructed of a metal or vice versa.

Figure 8A:
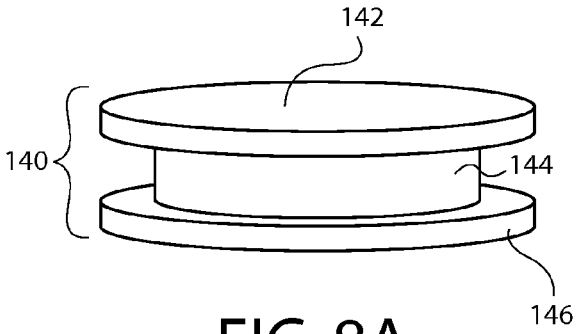
FIG. 8A is a top isometric view of a rod attachment according to one embodiment.

The roller shell 102 may include a rod attachment 140. The rod attachment 140 is configured to releasably secure the roller shell 102 to a heatable rod 122 as described below. In some implementations, the rod attachment 140 is substantially spool-shaped (see FIG. 8A). The rod attachment 140 may have a generally disk-shaped inner portion 142. The rod attachment 140 may have a generally disk-shaped outer portion 146. The inner portion 142 and outer portion 146 may have the same diameter or may have different diameters. Each diameter is less than the diameter of the corresponding flange 108. A recessed portion 144 may be defined by an annular recess between the inner portion 142 and the outer portion 146 of the rod attachment 140. The recessed portion 144 may have a smaller diameter than that of the inner portion 142 or the outer portion 146.

The rod attachment 140 may be constructed as a single piece. For example, the inner portion 142, outer portion 146, and recessed portion 144 may be formed (e.g., molded or milled) of a single material. Constructing a rod attachment 140 as a single piece may help create a durable rod attachment 140. As another example, the rod attachment 140 may be constructed of two or more pieces secured together by any means known in the art. For example, any two of or all of three of the inner portion 142, outer portion 146, and recessed portion 144 may be constructed as separate pieces and may be glued, welded, or otherwise fastened together.

In some implementations, part or all of the rod attachment 140 is constructed of a magnet or of one or more magnetic materials. In one embodiment, the rod attachment 140 may be a single magnet or single piece of magnetic material. In another embodiment, at least the inner portion 142 is a magnet or magnetic material.

The rod attachment 140 may be positioned on the inside of the roller shell 102, at or near the closed end 104, such as at or near a flange 108. The inner portion 142 of the rod attachment 140 may face towards the roller cavity 118 and may form the distal end of the roller cavity 118. The rod attachment 140 may be secured at or near the closed end 104 by any means known in the art. In the embodiment depicted in FIG. 4, the rod attachment 140 is molded into a portion of the roller shell 102. For example, the roller shell 102 may be insert molded around the rod attachment 140 whereby the material of the roller shell 102 fills the annular recess between the inner portion 142 and the outer portion 146 surrounding the recessed portion 144. In another embodiment, at least a portion of the roller shell 102, such as the inner wall 114, may be crimped to secure the rod attachment 140. In another embodiment, at least a portion of the rod attachment 140 is glued or otherwise adhered to a portion of the inside of the roller shell 102. For example, at least the outer portion 146 of the rod attachment 140 may be glued to the closed end 104 or the inside of a flange 108. The recessed portion 144 and/or the sides of the inner portion 142 may also be glued or adhered to the roller shell 102.

FIGS. 5 & 6 depict one embodiment of a heatable rod 122. The heatable rod 122 may comprise a substantially cylindrical body portion 130. The heatable rod 122 is configured to fit inside the roller cavity 118 of the roller shell 102, and to be releasably secured to the roller shell 102. The diameter of the body portion 130 is at least fractionally less than the diameter of the roller cavity 118 into which the heatable rod 122 may fit, as described below.

One end of the heatable rod 122 is a closed end 124. The closed end 124 may comprise a grip 128 that extends outward therefrom. The grip 128 may be any shape and size that is graspable and holdable by human fingers. For example, the grip 128 may be tab-shaped, as shown in FIGS. 5 & 6. In another embodiment, the grip 128 is knob-shaped. The grip 128 may be constructed of one or more heat-resistant or non-heat-conductive, thermally insulating materials. The grip 128 may allow a user to comfortably and safely hold a heated heatable rod 122 without burning the skin.

Figure 8B:
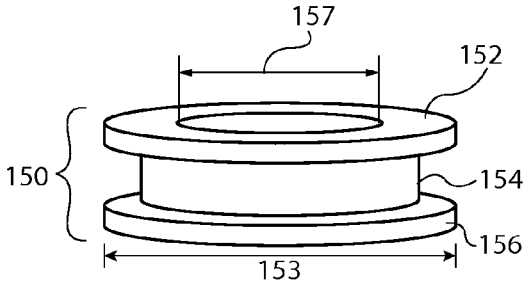
FIG. 8B is a top isometric view of a roller attachment according to one embodiment.

The other end of the heatable rod 122 is an open end 125. In some embodiments, the open end 125 comprises a roller attachment 150. In some implementations, the roller attachment 150 is substantially spool-shaped (see FIG. 8B). The roller attachment 150 may have a generally ring-shaped outer portion 152 and a generally ring-shaped inner portion 156. The outer portion 152 and inner portion 156 may have the same outer diameters 153 or may have different diameters. The outer portion 152 and inner portion 156 may have the same inner diameters 157 or may have different diameters. Each inner diameter 157 is at least fractionally greater than the diameter of a heating element post 174 as will be discussed further below. A recessed portion 154 may be positioned between the outer portion 152 and the inner portion 156 of the roller attachment 150. The recessed portion 154 may be substantially ring-shaped. The inner diameters 157 of each of the outer portion 152, inner portion 156, and recessed portion 154 may be aligned to form a rod opening 126. The rod opening 126 may be substantially cylindrical. The rod opening 126 may be wide enough to accept a post 174, as described below.

The roller attachment 150 may be constructed of a single piece. For example, the outer portion 152, inner portion 156, and recessed portion 154 may be formed (e.g., molded or milled) of a single material. Constructing a roller attachment 150 of a single piece may help create a durable roller attachment 150. As another example, the roller attachment 150 may be constructed of two or more pieces secured together by any means known in the art. For example, any two of or all of three of the outer portion 152, inner portion 156, and recessed portion 154 may be constructed as separate pieces and may be glued, welded, or otherwise fastened together.

In some implementations, part or all of the roller attachment 150 is constructed of a magnet or of one or more magnetic materials. In one embodiment, the roller attachment 150 may be a single magnet or single piece of magnetic material. In another embodiment, at least the outer portion 152 is a magnet or magnetic material.

Figure 7:
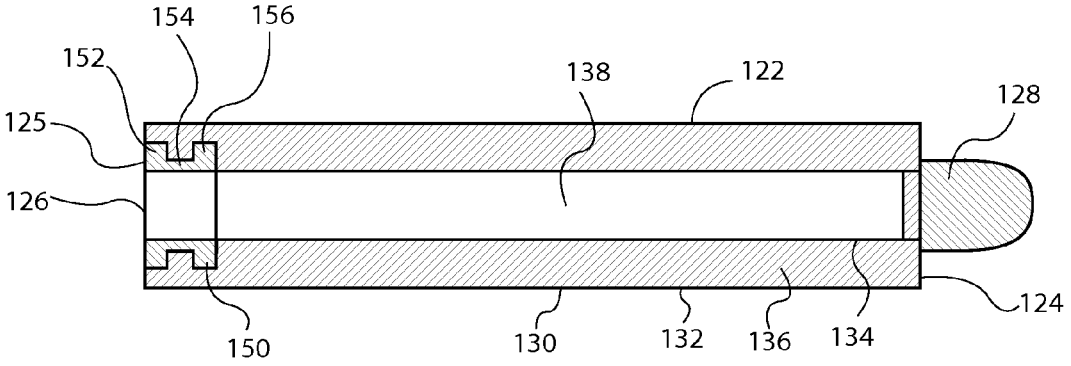
FIG. 7 is an elevation view in cross section taken along line 7 in FIG. 5.

With reference to FIG. 7, the roller attachment 150 may be positioned on the inside of the heatable rod 122, at or near the open end 125. The inner portion 156 of the roller attachment 150 may be positioned towards the rod cavity 138. The outer portion 152 of the roller attachment 150 may be positioned towards the open end 125. The roller attachment 150 may be secured at or near the open end 125 by any means known in the art. In the embodiment depicted in FIG. 7, the roller attachment 150 is molded into a portion of the heatable rod 122. For example, the heatable rod 122 may be insert molded around the roller attachment 150. In another embodiment, at least a portion of the heatable rod, such as the outer wall 132, may be crimped to secure the roller attachment 150. In another embodiment, at least a portion of the roller attachment 150 may be glued or otherwise adhered to a portion of the inside of the heatable rod 122. For example, at least the inner portion 156 of the roller attachment 150 may be glued at or near the open end 125. The recessed portion 154 and/or the sides of the outer portion 152 may also be glued or adhered to the heatable rod 122.

In some embodiments, some or all of the body portion 130, closed end 124, grip 128, and roller attachment 150 are integrally molded to form the heatable rod 122. In some embodiments, some or all of the body portion 130, closed end 124, grip 128, and roller attachment 150 are separate pieces secured together by any means know in the art, such as gluing or bonding.

With further reference to FIG. 7, the heatable rod 122 may be made (e.g., by molding) of a thermally conductive material 136 with good heat transfer properties or it may be double-walled with a thermally conductive filler in between. The heatable rod 122 has an outer wall 132 and inner wall 134. Each wall 132, 134 may be any thickness. The outer wall 132 may define the exterior of at least the body portion 130 of the heatable rod 122. The outer wall 132 may extend to the roller attachment 150 or to the open end 125. The inner wall 134 may extend to the roller attachment 150 or to the open end 125. The inner wall 132 may surround and define a rod cavity 138. The rod cavity 138 is configured to receive a post 174.

If double-walled, the outer wall 132 and inner wall 134 may define an annular space between the outer and inner walls 132, 134 that is filled with a heat conductive filler material. The thermally conductive material 136 or the combination of the outer wall 132, inner wall 134, and the filler material may be constructed of one or more known thermally conductive materials. For example, the thermally conductive material 136 may be boron nitride, silica, a metal, such as aluminum, a plastic, a polymer, an epoxy, or an elastomer, such as a thermoplastic elastomer or resin. A thermoplastic elastomer or resin may be, for example, a block copolymer, butadiene, ethylene propylene, isoprene, polystyrene, polyisoprene, polycarbonate, polypropylene, propylene, or any combination thereof. The thermally conductive material 136 or the combination of the outer wall 132, inner wall 134, and the filler material may also be constructed of any one or more known heat-retaining materials. The outer wall 132, inner wall 134, and filler material may be constructed of the same or different materials. For example, the outer wall 132 may be constructed of a plastic and the filler material may be constructed of a metal or vice versa.

Figure 1:
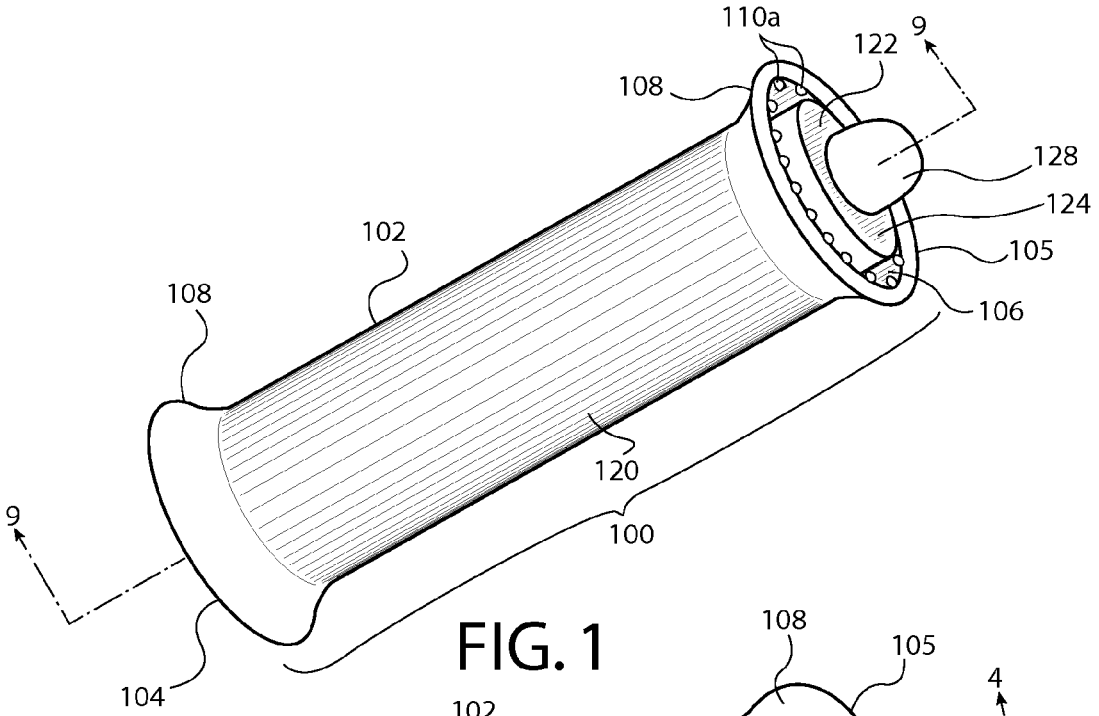
FIG. 1 is a front isometric view of a heatable hair roller according to one embodiment.
Figure 9:
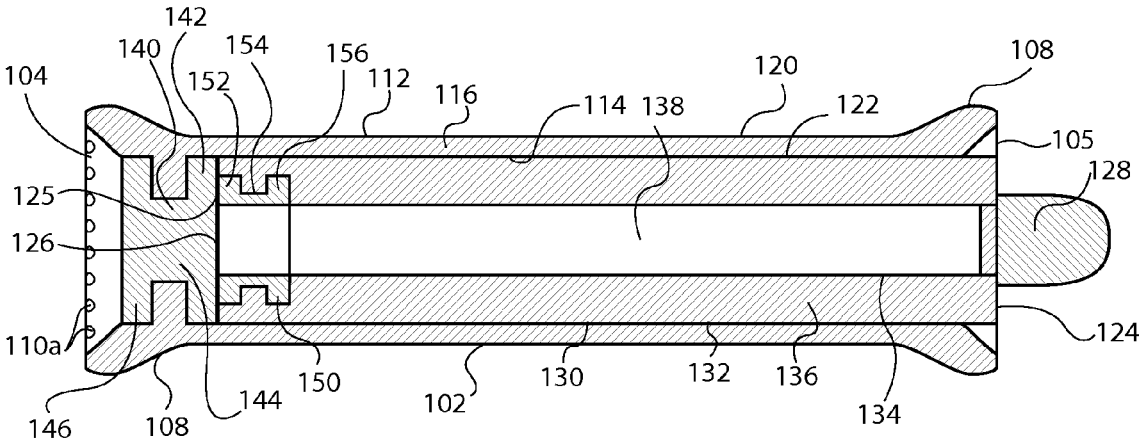
FIG. 9 is an elevation view in cross section taken along line 9 in FIG. 1.

FIGS. 1 & 9 depict one embodiment of a heatable hair roller 100 with the heatable rod 122 inserted into the roller shell 102. In the depicted embodiment, the length of the body portion 130 of the heatable rod 122 is approximately the same as the length of the bobbin portion 120 of the roller shell 102. In other embodiments, the length of the body portion 130 of the heatable rod 122 is longer than or shorter than the length of the bobbin portion 120 of the roller shell 102. When the heatable rod 122 is fully inserted into the roller shell 102, the closed end 124 of the heatable rod 122 may be flush with the plane of the open end 105 of roller shell 102, or the closed end 124 may sit above or below the plane of the open end 105 of the roller shell 102. When the heatable rod 122 is fully inserted into the roller shell 102, the grip 128 of the heatable rod 122 extends beyond the plane of the open end 105 of the roller shell 102. This configuration exposes the grip 128 so it can be grasped when inserting or removing the heatable rod 122 from the roller shell 102.

The heatable rod 122 fits inside the roller cavity 118. The outer circumference of the heatable rod 122 is at least fractionally less than the circumference of the roller cavity 118. The heatable rod 122 may fit closely or snugly inside the roller cavity 118. A snug fit may improve heat transfer between the heatable rod 122 and the roller shell 102 compared to a loose fit.

The heatable rod 122 is releasably secured to the roller shell 102. The heatable rod 122 may be releasably secured at a rod attachment 140. The heatable rod 122 may be releasably secured by any means known in the art. In one embodiment, the heatable rod 122 is constructed of metal and the rod attachment 140 is constructed of a magnet or magnetic material. The heatable rod 122 is secured to the rod attachment 140 by magnetic attraction between the metal of the heatable rod 122 and the magnet of the rod attachment 140.

In another embodiment, the heatable rod 122 comprises a roller attachment 150. The roller attachment 150 and rod attachment 140 are operationally compatible. For example, the roller attachment 150 may be constructed of metal and the rod attachment 140 may be constructed of a magnet or magnetic material. The roller attachment 150 may be secured to the rod attachment 140 by magnetic attraction between the metal of the roller attachment 150 and the magnet of the rod attachment 140. The face of the inner portion 142 of the rod attachment 140 distal to the outer portion 146, and the face of the outer portion 152 of the roller attachment 150 distal to the inner portion 156 may be complementarily shaped. For example, each face may be substantially flat. The complementary shape may help to improve the security of the connection between the roller attachment 150 and the rod attachment 140.

In another example, the roller attachment 150 is constructed of a magnet or magnetic material and the rod attachment 140 is constructed of a magnet or magnetic material. The roller attachment 150 is secured to the rod attachment 140 by magnetic attraction between the roller attachment 150 and the rod attachment 140. The face of the inner portion 142 of the rod attachment 140 distal to the outer portion 146, and the face of the outer portion 152 of the roller attachment 150 distal to the inner portion 156 may be complementarily shaped. For example, each face may be substantially flat. The complementary shape may help to improve the security of the connection between the roller attachment 150 and the rod attachment 140.

In a further example, the roller attachment 150 may comprise a key and the rod attachment 140 may comprise a complementarily-shaped slot. The roller attachment 150 may be releasably secured to the rod attachment 140 by seating the key of the roller attachment 150 into the slot of the rod attachment 140. Rotating the heatable rod 122 in one direction may lock the key into the slot, and rotating the heatable rod 122 in the opposite direction may release the key from the slot.

In a still further example, the roller attachment 150 may comprise an annular boss and the rod attachment 140 may comprise a complementarily-shaped recess. The roller attachment 150 may be releasably secured to the rod attachment 140 by snap-fitting the boss of the roller attachment 150 into the recess of the rod attachment 140.

The roller shell 102 may be secured to the user's hair by any means known in the art including pins, clips, and straps. In some implementations, a roller strap 160 is provided with the roller shell 102 and heatable rod 122. The roller strap 160 may secure the roller shell 102, with or without the heatable rod 122 inserted, to a user's hair.

Figure 10:
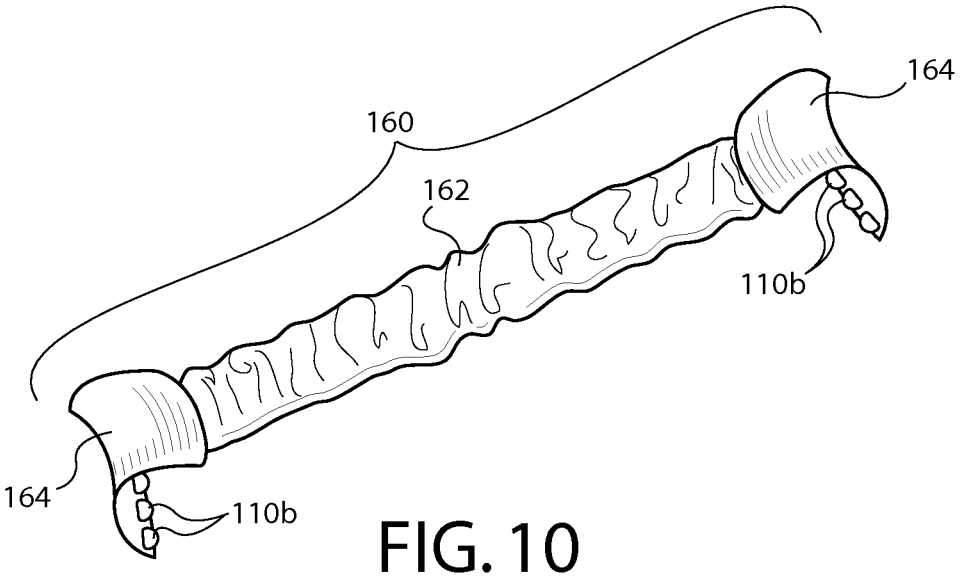
FIG. 10 is a top isometric view of a roller strap according to one embodiment.
Figure 11:
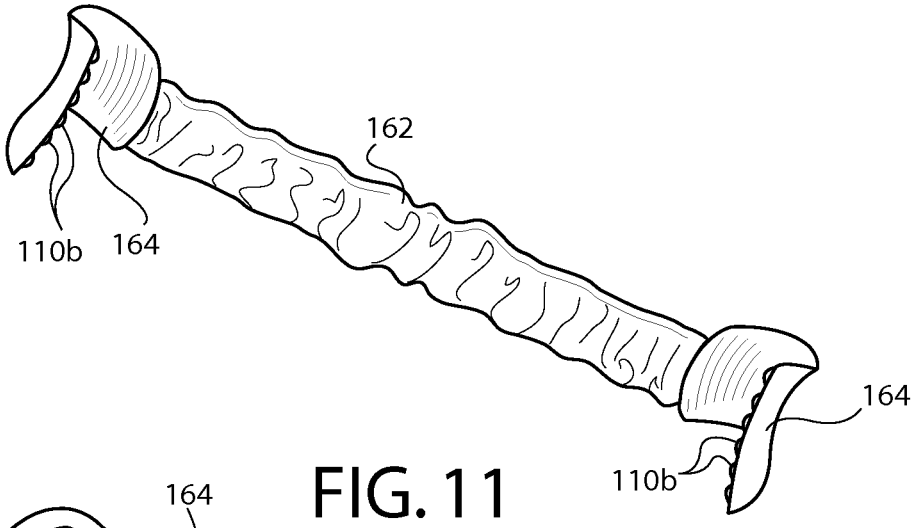
FIG. 11 is a bottom isometric view of the roller strap of FIG. 10.

In the embodiment depicted in FIGS. 10 & 11, the roller strap 160 comprises a band 162. The band 162 may be constructed of any stretchable, extensible, and/or soft material. Stretchable materials include, for example, elastic, elastane, or nylon. In the construction and use of the roller strap 160, a material that is stretchable may help secure the roller strap 160 to a roller shell 102.

Figure 12:
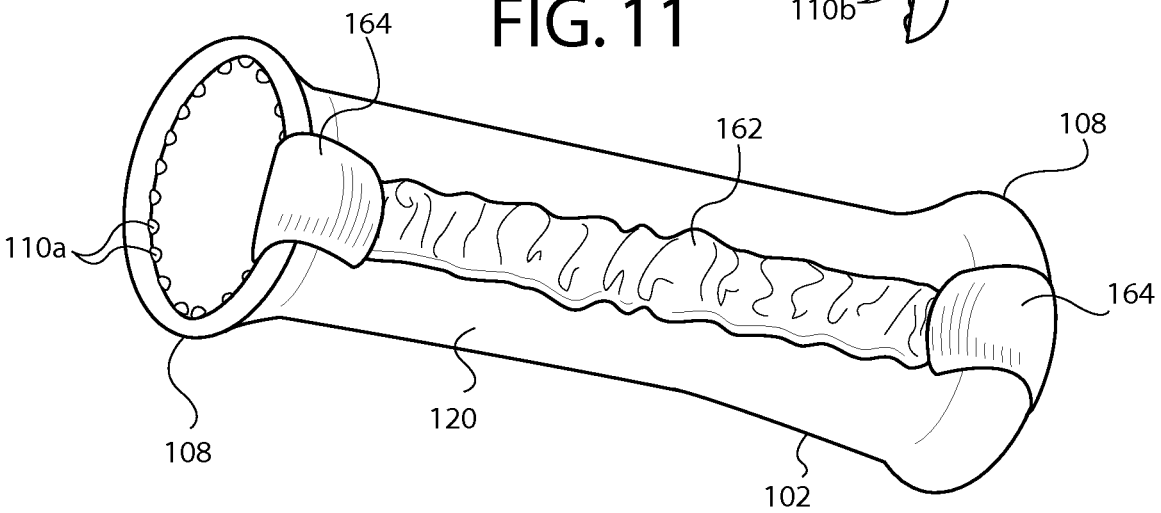
FIG. 12 is a front isometric view of the roller strap of FIG. 10 secured to the roller shell of FIG. 2.

The band 162 may be any length when relaxed. For example, the band 162 may be shorter than the length of the bobbin portion 120 of a roller shell 102. The band 162 may be a different, longer length when stretched. For example, as shown in FIG. 12, the band 162 may be approximately the length of the bobbin portion 120 of a roller shell 102 when it is applied to a roller shell 102.

The band 162 may be partially or completely covered by a soft or spongy material. The material may be any natural or synthetic fabric such as cotton, microfiber, polyester, or viscose, or may be foam, for example, polyethylene foam. The material may be of any thickness. Multiple roller straps 160 may be provided with bands 162 covered by different thickness of soft or spongy material. In the construction and use of the roller strap 160, a material that is soft or spongy may prevent the band 162 from getting caught on the user's hair and/or may help prevent the band 162 from making a temporary crease or crimp in the user's hair. A material that is spongy may also help secure hair to the roller shell 102. Thicker spongy material may help secure fine or thin hair to the roller shell 102 better than thinner spongy material.

The band 162 may be flanked on one or both ends by a hook 164. The hook 164 may be any material known in the art, such as metal or plastic. The hook 164 may be any size and shape known in the art. For example, as shown in FIGS. 10 and 11, each hook 164 is curved. As shown in FIG. 12, each hook 164 is deep enough to fit over or around a flange 108 of a roller shell 102. Each hook 164 may help secure a roller strap 160 to a roller shell 102.

In some embodiments, one or more hooks 164 are provided with teeth 110*b*. The teeth 110*b* may be positioned on the inside surface of the hook 164. The teeth may be positioned on the edge of a hook 164 distal from the juncture between the hook 164 and the band 162. The teeth 110*b* may be any size and shape know in the art including, but not limited to, substantially pyramidal or hemispherical. The teeth 110*b* are operationally compatible with the teeth 110*a* on a flange 108 of a roller shell 102. For example, as shown in FIG. 12, the teeth 110*a*, 110*b* may fit between each other. The teeth 110*a*, 110*b* may help secure a roller strap 160 to a roller shell 102, such as by limiting slippage of the roller strap 160 on the roller shell 102.

Figure 13:
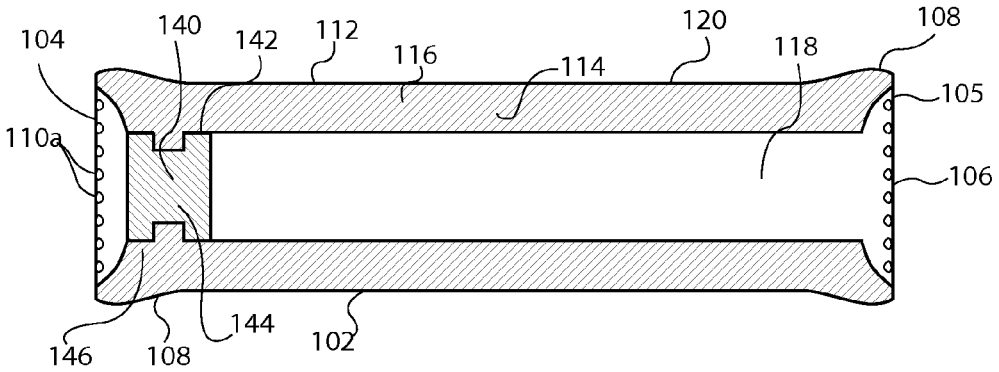
FIG. 13 is an isometric view in cross section of a roller shell according to another embodiment.

FIG. 13 depicts a cross-section of a roller shell 102 according to another exemplary embodiment. The roller shell 102 of FIG. 13 may be used in conjunction with the heatable rod 122 and optional roller strap 160 of FIGS. 1-12. The roller shell 102 of FIG. 13 is of substantially the same form and construction as the roller shell 102 of FIGS. 2-4. In this embodiment, the width between the outer wall 112 and inner wall 114 is greater than the width between the outer wall 112 and inner wall 114 in FIG. 4 such that the thickness of the thermally conductive material 116 is greater in this embodiment than in FIG. 4. If the roller shell 102 is double-walled, the width of the annual space is greater than the width of the annular space in FIG. 4. The thickness of the thermally conductive material 116 may be any thickness. In the construction and use of the heatable hair roller 100, variable thermally conductive material 116 thicknesses help allow one diameter of heatable rod 122 to be used with a variety of outer diameters of roller shells 102. The thermally conductive material 116 or filler may be any of those as described above.

Figure 14:
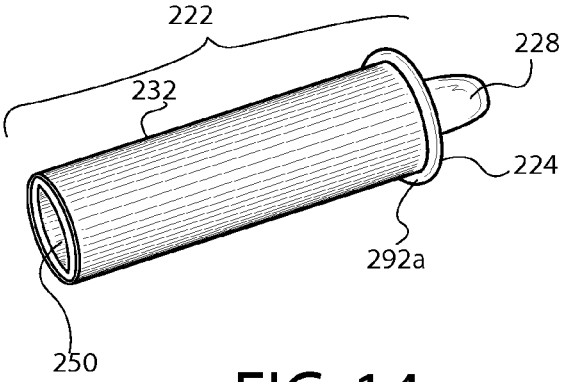
FIG. 14 is front isometric view of heatable rod according to another embodiment.

FIG. 14 depicts another exemplary embodiment of a heatable rod 222 for use with a variety of outer diameters of roller shells 102. The heatable rod 222 of this embodiment may be provided with the expansion sleeve 290 of FIG. 15. The expansion sleeve 290 fits over a heatable rod 222, as shown in FIG. 16, to increase the effective outer diameter of the heatable rod 222. The heatable rod 222 with expansion sleeve 290 is used in conjunction with the roller shell 102 and optional roller strap 160 of FIGS. 1-12. The expansion sleeve 290 may help to fill a separation space between the outer diameter of a heatable rod 222 and the inner diameter of a roller cavity 118.

The heatable rod 222 of FIG. 14 is of substantially the same form and construction as the heatable rod 122 of FIGS. 5-7. The heatable rod 222 may also comprise a sleeve attachment 292*a* at or near the closed end 224. The sleeve attachment 292*a* may be of any form. In the exemplary embodiment of FIG. 14, the sleeve attachment 292*a* is a substantially flat, ring-shaped flange that encircles the grip 228. The sleeve attachment 292*a* may extend beyond the outer wall 232 of the heatable rod 222. The sleeve attachment 292*a* may be integrally formed with the heatable rod 122 or otherwise secured to the heatable rod 222 by any known means, such as bonding, gluing, snap fitting around the grip 228, or overmolding.

Figure 15:
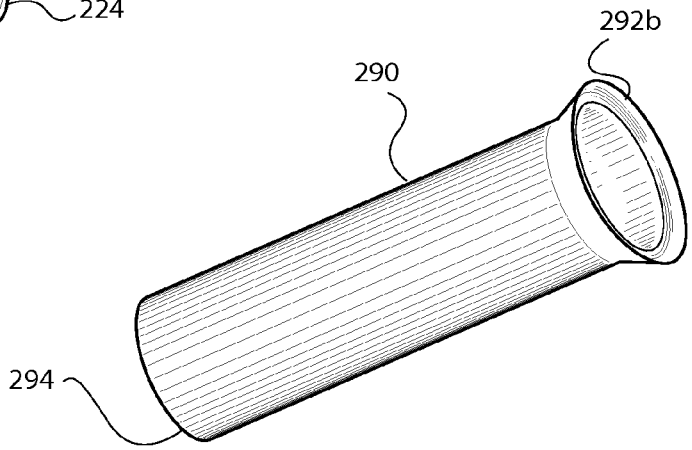
FIG. 15 is rear isometric view of an expansion sleeve according to one embodiment.
Figure 16:
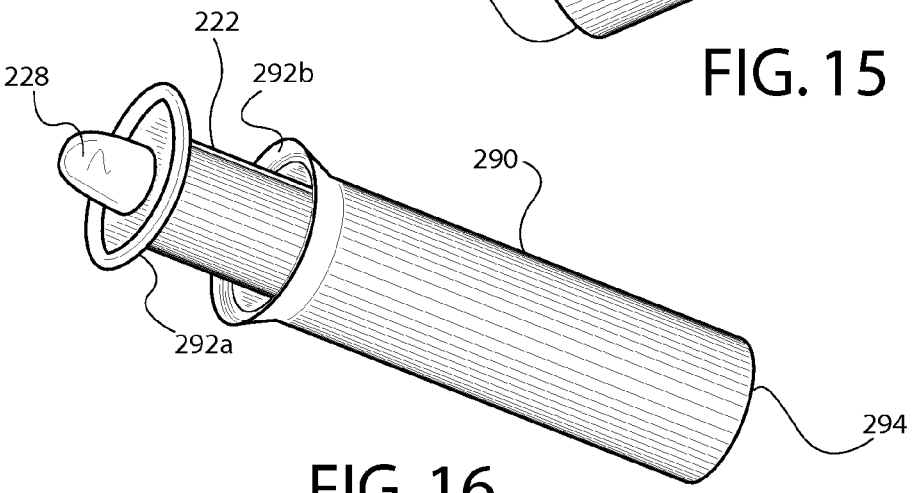
FIG. 16 is rear isometric view of the expansion sleeve of FIG. 15 being applied to the heatable rod of FIG. 14.

With reference to FIG. 15, the expansion sleeve 290 may be substantially tubular in shape. The length of the expansion sleeve 290 may be approximately the length of the heatable rod 222. The expansion sleeve 290 may be single-walled or multi-walled. The expansion sleeve 290 has an outer wall, inner wall, and thermally conductive material or filler substantially as described for the heatable rod 122 of FIGS. 5-7. The expansion sleeve 290 may be constructed of any one or more heat-conductive materials as described for the heatable rod 122 of FIGS. 5-7.

The internal diameter of the expansion sleeve 290 may be fractionally greater than the exterior diameter of the heatable rod 222. When the expansion sleeve 290 is fitted over a heatable rod 222 as shown in FIG. 16, the expansion sleeve 290 may fit closely or snugly over the heatable rod 222. A snug fit may help transfer heat between the heatable rod 222 and the expansion sleeve 290.

The external diameter of the expansion sleeve 290 may be fractionally less than the diameter 157 of the roller cavity 118. When the roller shell 102 is fitted over an expansion sleeve 290, the roller shell 102 may fit closely or snugly over the expansion sleeve 290. A snug fit may help transfer heat between the expansion sleeve 290 and the roller shell 102.

The expansion sleeve 290 may comprise an open end 294 and a sleeve attachment 292*b* at the opposing end. When the expansion sleeve 290 is fitted over the heatable rod 222 as shown in FIG. 16, the roller attachment 250 of the heatable rod 222 is exposed in the open end 294 of the expansion sleeve 290.

The sleeve attachment 292*b* may be of any form. In the exemplary embodiment of FIG. 15, the sleeve attachment 292*b* is substantially flat and ring-shaped. The sleeve attachment 292*b* may be integrally formed with the expansion sleeve 290 or otherwise secured to the expansion sleeve 290 by any known means, such as bonding, gluing, or molding.

The heatable rod 222 and expansion sleeve 290 may be releasably secured to each other, such as by the sleeve attachments 292*a,b*. The sleeve attachments 292*a,b* may be operationally compatible. For example, one sleeve attachment 292 may be constructed of metal and the other sleeve attachment 292 may be constructed of a magnet or magnetic material. As another example, both sleeve attachments 292*a,b* may be constructed of a magnet or magnetic material. In these examples, the sleeve attachments 292*a,b* are secured to each other by magnetic attraction.

In another example, one sleeve attachment 292 may comprise a key and the other sleeve attachment 292 may comprise a complementarily-shaped slot. The sleeve attachments 292*a, b* may be releasably secured to each other by seating the key of one sleeve attachment 292 into the slot of the other sleeve attachment 292. Rotating the heatable rod 222 in one direction may lock the key into the slot, and rotating the heatable rod 222 in the opposite direction may release the key from the slot.

In a further example, one sleeve attachment 292 may comprise an annular boss and the other sleeve attachment 292 may comprise a complementarily-shaped recess. The sleeve attachments 292*a, b* may be releasably secured to each other by snap-fitting the boss into the recess. The heatable rod 222 and expansion sleeve 290 may be secured to each other before being heated, as described below.

In another exemplary embodiment (not shown), an expansion sleeve is used in conjunction with the heatable rod 122 of FIGS. 5-7. In this embodiment, the expansion sleeve may be of substantially the same form and construction as the expansion sleeve 290 of FIG. 15, but the open end of the expansion sleeve may be applied over the closed end 124 of the heatable rod 122. Compared to the sleeve attachment 292*b* of the embodiment of FIG. 15, the diameter of the center of the ring-shaped sleeve attachment of this embodiment is smaller. The diameter of the center of the ring is less than the external diameter of the heatable rod, such that when the expansion sleeve is applied to the heatable rod 122, the sleeve attachment may rest on top of the closed end 124 of the heatable rod 122. The grip 128 of the heatable rod 122 may protrude through the center of the sleeve attachment. The expansion sleeve of this embodiment may be releasably secured to a heatable rod 122 by any means described above for the expansion sleeve 290 and heatable rod 222 of FIGS. 14-16. The expansion sleeve may help to fill a separation space between the outer diameter of a heatable rod 122 and the inner diameter of a roller cavity 118.

Figure 17:
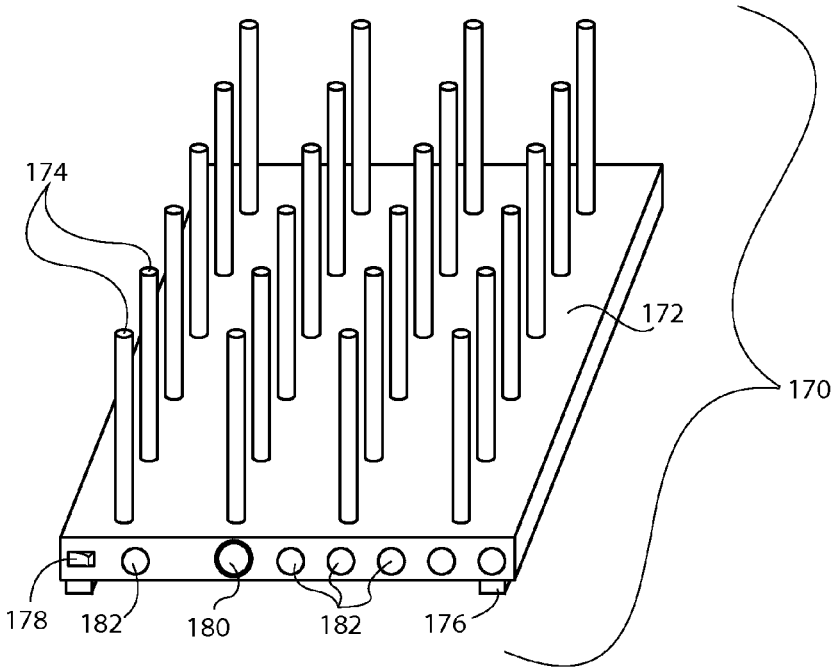
FIG. 17 is a front isometric view of a heating unit according to one embodiment.
Figure 18:
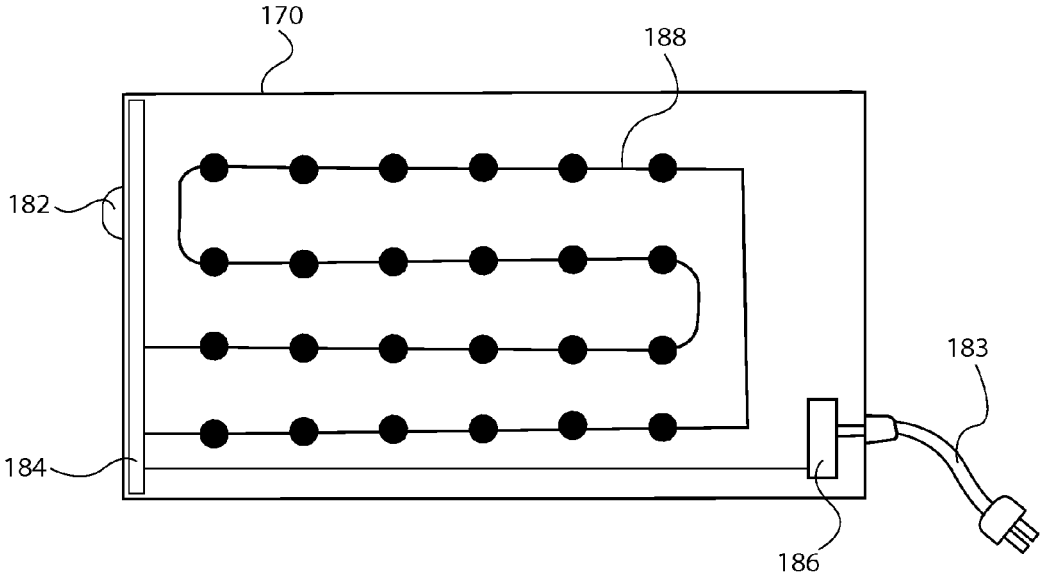
FIG. 18 is a bottom plan view of the heating element of FIG. 17.

In some implementations, the heatable hair rollers 100 are provided with a heating unit 170. With reference to FIGS. 17 & 18, the heating unit 170 comprises a base plate 172. The base plate 172 may be supported by one or more feet 176. Any number of substantially vertical heating element posts 174 extend from the top surface of the plate 172. In the exemplary embodiment of FIG. 17, twenty-four posts 174 are substantially evenly spaced on the plate 172. The posts 174 may be constructed of any heat-conductive but electrically resistive material or combination of materials known in the art. For example, the posts 174 may be capped by a metal, such as stainless steel or aluminum, while the core can be an electrically resistive material such as carbon, carbon composites, or other known resistive materials. The height of the posts 174 may be approximately the same as the length of the cavity 138 of a heatable rod 122, 222. The diameter of the posts 174 may be fractionally less than the diameter of the cavity 138 of a heatable rod 122, 222. The posts 174 may provide heat to the heatable rods 122, 222.

The heating unit 170 may also include a variety of controls and function indicators positioned on any surface of the heating unit 170. In the exemplary embodiment depicted in FIG. 17, the controls and function indicators are positioned on the front face of the heating unit 170. The controls in the embodiment of FIG. 17 include a power switch 178. The power switch 178 may be, for example, a toggle switch. The controls in the embodiment of FIG. 17 also include a rheostat 180 or other circuit component for power control. The rheostat 180 may control, for example, temperature of the heating unit 170. The rheostat 180 may rotate incrementally to select preset temperatures or may rotate continuously to select a continuum of temperatures. Selected temperatures may range from, for example, about 80° F. to about 300° F. In other embodiments, the rheostat 180 may also control power to the heating unit 170.

In the exemplary embodiment depicted in FIG. 17, the function indicators may include a plurality of LED lights 182. An LED light 182 may be connected to a thermocouple and when lit may indicate that the heating unit 170 has reached a selected temperature. Other LED lights 182 may indicate that a specific temperature setting has been selected. For example, separate LED lights 182 may indicate selection of each of a low, low/medium, medium, medium/high, and high temperature setting.

In the operation of the heating unit 170, current from a power cord 183 may pass through an inverter 186 to a circuit board 184 (see FIG. 18). The controls and function indicators described above may be potted to the circuit board 184. Current may also pass through a circuit 188 to or into each post 174. Electrical conductivity in the posts 174 may be poor such that resistive heat is generated. The heated posts 174 may in turn heat heatable rods 122, 222 that have been placed over the posts 174. The temperature of the heatable rods 122, 222 may be controlled by the rheostat 180.

Figure 19:
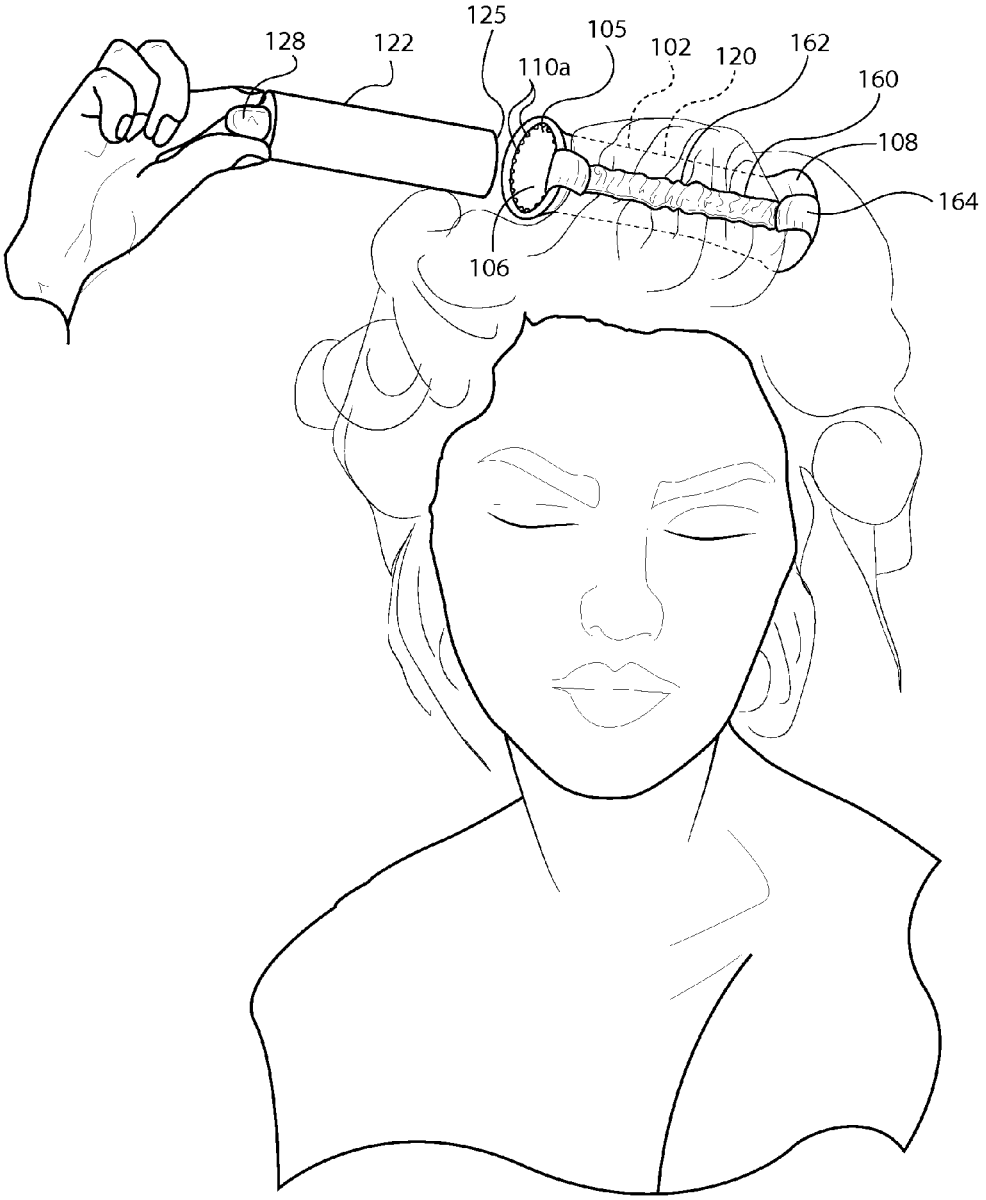
FIG. 19 is a schematic of the heatable hair roller of FIG. 1 and the roller strap of FIG. 10 used in a user's hair.

By way of example, but not limitation, the heatable hair roller 100 of FIGS. 1-12 may be used with the heating unit 170 of FIGS. 17 & 18 to curl a user's hair according to the following procedure. One or more heatable rods 122 are heated by heat transfer from the posts 174 of the heating unit 170 over which the heatable rods were placed. Before, during, or after the heatable rods 122 are being heated, a section of dry or wet hair is separated from the rest of the user's hair as depicted in FIG. 19. The section of hair is wound around the bobbin portion 120 of a roller shell 102 until the entire length, or just a portion of the length, is wound. The roller shell 102 is held in place while a roller strap 160 is releasably secured to the roller shell 102 by hooking a hook 164 over a flange 108, and pulling on the free end of the roller strap 160 to stretch the band 162 the length of the roller shell 102. The wound hair is captured between the roller shell 102 and the band 162. Then the opposing hook 164 is hooked over the opposing flange 108. The roller strap 160 may be secured first at either the closed end 104 or the open end 105 of the roller shell 102. If provided, the teeth 110*b* of a hook 164 can be seated between the teeth 110*a* of a flange 108 to help secure the roller strap 160 to the roller shell 102.

While holding a heated heatable rod 122 at the grip 128, the open end 125 of the heatable rod 122 is inserted into the open end 105 of the roller shell 102. The heatable rod 122 is moved past the roller opening 106 into the roller cavity 118 such that the outer wall 132 of the heatable rod 122 is in contact with, the inner wall 114 of the roller shell 102. The heatable rod 122 is inserted until the heatable rod 122 is releasably secured to the roller shell 102. In the embodiment depicted in FIG. 19, the heatable rod 122 is inserted until the roller attachment 150 and rod attachment 140 are close enough that magnetic attraction between them secures them together. The heatable rod 122 heats the roller shell 102. Heating the roller shell 102 to a surface temperature of approximately 175-200° F. produces curls in most or all hair types. Heating the roller shell 102 to a surface temperature of approximately 80-175° F. produces a wave or curl depending on the hair type. Heating the roller shell 102 to a surface temperature of approximately 80° F. produces a wave in most or all hair types.

The process described above may be repeated for additional sections of hair. After the desired amount of time has passed, which may be after the heatable rod 122 has heated the roller shell 102 and the roller shell 102 has subsequently cooled off, the heatable rod 122 is removed from the roller shell 102 by pulling on the grip 124 until the magnetic attraction between the roller attachment 150 and rod attachment 140 is overcome. The roller strap 160 is removed from the roller shell 102 by pulling on a hook 164 to release it from a flange 108, and then releasing the opposing hook 164 from the opposing flange 108. Alternatively, the heatable rod 122 remains secured to the roller shell 102 while the roller strap 160 is removed. The curled section of hair is then unwound from the roller shell 102.

In another procedure for using the heatable hair roller 100 of FIGS. 1-12 to curl a user's hair, a heatable rod 122 is removed from a roller shell 102 as described above after the heatable rod 122 has partially or completely cooled. The heatable rod 122 is then reheated in the heating unit 170 as described above. The reheated heatable rod 122 is then re-inserted into a roller shell 102, which has remained secured to the user's hair. A roller shell 102 may be reheated in this manner any desired number of times. Reheating a roller shell 102 and re-inserting it into a roller shell 102 may help to produce a more durable or longer lasting curl.

In a similar procedure as that described immediately above, a reheated heatable rod 122 is inserted into a roller shell 102 that has not yet been heated. A number of roller shells greater than the number of heatable rods are thereby heated.

The heatable rod 222 and expansion sleeve 290 of FIGS. 14-16 may be used with the heating unit 170 of FIGS. 17 & 18 to curl a user's hair according to the following procedure. The open end 125 of the heatable rod 222 is inserted through the sleeve attachment 292*b* of the expansion sleeve 290 until the sleeve attachments 292*a,b* are close enough that magnetic attraction between them secures them together. One or more heatable rods 222 with an attached expansion sleeve 290 are then heated as described above. A user's hair is wound around a roller shell 102 and a roller strap 160 is secured to the roller shell 102 as described above. A heatable rod 222 with an attached expansion sleeve 290 is inserted into a roller shell 102 as described above for the heatable rod 122 alone. After the desired amount of time has passed, the heatable rod 222 with attached expansion sleeve 290 is removed from the roller shell 102 as described above for the heatable rod 122 alone. The heatable rod 222 with attached expansion sleeve 290 may remain secured together for subsequent use, or the expansion sleeve 290 may be removed from the heatable rod 222 by pulling on the expansion sleeve 290 until the magnetic attraction between the sleeve attachments 292*a,b* is overcome.

In another procedure for curling a user's hair, another embodiment of an expansion sleeve (not shown) is applied over the closed end 124 of the heatable rod 122 of FIGS. 5-7. One or more combined heatable rods 122 and expansion sleeves are then heated as described above. A user's hair is wound around a roller shell 102 and a roller strap 160 is secured to the roller shell 102 as described above. A combined heatable rod 122 and expansion sleeve is inserted into a roller shell 102 as described above for the heatable rod 122 alone. After the desired amount of time has passed, the combined heatable rod 122 and expansion sleeve is removed from the roller shell 102 as described above. The combined heatable rod 122 and expansion sleeve may remain together for subsequent use, or the expansion sleeve may be removed from the heatable rod 122 by pulling them apart.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present invention, and do not create limitations, particularly as to the position, orientation, or use of the invention. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. The exemplary drawings are for purposes of illustration only and the dimensions, positions, order and relative sizes reflected in the drawings attached hereto may vary.

The above specification, examples and data provide a complete description of the structure and use of exemplary embodiments of the invention as defined in the claims. Although various embodiments of the claimed invention have been described above with a certain degree of particularity, or with reference to one or more individual embodiments, those skilled in the art could make numerous alterations to the disclosed embodiments without departing from the spirit or scope of the claimed invention. Other embodiments are therefore contemplated. It is intended that all matter contained in the above description and shown in the accompanying drawings shall be interpreted as illustrative only of particular embodiments and not limiting. Changes in detail or structure may be made without departing from the basic elements of the invention as defined in the following claims.

What is claimed is:

1. A heatable hair roller comprising a heatable rod having a first end and a second end; and a roller shell configured to releasably receive the heatable rod in a roller cavity, wherein the roller shell and the heatable rod comprise a magnetic interconnection configured to releasably secure the roller shell to the heatable rod, the magnetic connection is positioned at the first end of the heatable rod, and a thermally insulating grip extends outward from the second end of the heatable rod beyond a plane of an open end of the roller shell, wherein once the heatable rod is heated, the heatable rod is placed into the roller shell that is previously rolled up within the hair, the heatable rod can be removed from the roller shell once a hair curling process has been completed leaving the roller shell in the hair until a time of styling, or at any time during the hair curling process the heatable rod can be removed from the roller shell within the hair or the roller shell and the heatable rod can be removed from the hair at the same time.

2. The heatable hair roller of claim 1, wherein the roller shell comprises a rod attachment as part of the magnetic interconnection and the rod attachment comprises a magnet configured to releasably secure the roller shell to the heatable rod.

3. The heatable hair roller of claim 1, wherein the heatable rod comprises a roller attachment as part of the magnetic interconnection and the roller attachment comprises a magnet configured to releasably secure the heatable rod to the roller shell.

4. The heatable hair roller of claim 1, wherein the roller shell is constructed of a thermally conductive material.

5. The heatable hair roller of claim 1, comprising an expansion sleeve configured to receive a heatable rod and to be received by the roller shell, wherein the expansion sleeve fills a separation space between the heatable rod and roller cavity.

6. The heatable hair roller of claim 1, wherein the roller shell comprises an open end and a closed end and the magnetic connection is positioned inside the closed end.

7. The heatable hair roller of claim 1, wherein either or both of the roller shell or the heatable rod is constructed with a thermally conductive filler between a double wall.

8. A heatable hair roller system comprising at least one heatable rod having a first end and a second end, at least one roller shell configured to releasably receive a heatable rod in a roller cavity defined by the roller shell, and a heating unit, wherein the roller shell and the heatable rod comprise a magnetic interconnection configured to releasably secure the roller shell to the heatable rod, the magnetic connection is positioned at the first end of the heatable rod, and a thermally insulating grip extends outward from the second end of the heatable rod beyond a plane of an open end of the roller shell, wherein once the heatable rod is heated, the heatable rod is placed into the roller shell that is rolled up within the hair, the heatable rod can be removed from the roller shell once a hair curling process has been completed leaving the roller shell in the hair until a time of styling, or at any time during the hair curling process the heatable rod can be removed from the roller shell within the hair or the roller shell and the heatable rod can be removed from the hair at the same time.

9. The system of claim 8, wherein the roller shell comprises a rod attachment as part of the magnetic interconnection and the rod attachment comprises a magnet configured to releasably secure the roller shell to the heatable rod.

10. The system of claim 8, wherein the heatable rod comprises a roller attachment as part of the magnetic interconnection and the roller attachment comprises a magnet configured to releasably secure the heatable rod to the roller shell.

11. The system of claim 8, wherein the roller shell is constructed of a thermally conductive material.

12. The system of claim 8, comprising an expansion sleeve configured to receive a heatable rod and to be received by the roller shell, wherein the expansion sleeve fills a separation space between the heatable rod and roller cavity.

13. The system of claim 8, comprising a roller strap configured to secure the roller shell to hair.

14. The system of claim 8, wherein the roller strap comprises at least one hook configured to secure the roller strap to the roller shell.

15. The system of claim 14, wherein the hook comprises teeth configured to secure the roller strap to the roller shell.

16. The system of claim 8, wherein the heating unit comprises a post configured to heat the heatable rod.

17. The system of claim 8, wherein the roller shell comprises an open end and a closed end and the magnetic connection is positioned inside the closed end.

18. The system of claim 8, wherein either or both of the roller shell or the heatable rod is constructed with a thermally conductive filler between a double wall.

19. A method of using a heatable hair roller system comprising providing a heatable hair roller system comprising at least one heatable rod, at least one roller shell configured to releasably receive a heatable rod in a roller cavity defined by the roller shell, and a heating unit, wherein the roller shell and the heatable rod comprise a magnetic interconnection configured to releasably secure the roller shell to the heatable rod;

heating the heatable rod in the heating unit;

winding a section of hair around the roller shell;

securing the roller shell to the hair;

inserting the heated heatable rod into the roller shell; and removing the heatable rod from the roller shell and leaving the roller shell in the hair.

20. The method of claim 19 further comprising securing the heatable rod inside the roller shell by engaging the magnetic interconnection of the roller shell and heatable rod.

21. The method of claim 19 further comprising securing the roller shell to the hair by pins, clips, or straps.

22. The method of claim 19 further comprising securing the roller shell to the hair while the roller shell is at room temperature such that a user's fingers are not burned.

23. The method of claim 19 further comprising inserting the heated heatable rod into the roller shell by pinching a thermally insulating grip extending outward from the heatable rod beyond a plane of an open end of the roller shell such that a user's fingers are not burned.

24. The method of claim 23 further comprising removing the heatable rod from the roller shell by pulling on the thermally insulating grip such that a user's fingers are not burned.

25. The method of claim 23, further comprising removing the heatable rod when the roller has become too hot in the hair or on the scalp;

waiting for the heatable rod to cool off slightly; and reinserting the heatable rod into the roller shell, wherein the user does not re-roll the hair.

26. The method of claim 19 further comprising removing the heatable rod from the roller shell while the heatable rod is still hot such that the hair is not damaged or the scalp is not burned.

27. The method of claim 19 further comprising removing the heatable rod from the roller shell;

re-heating the heatable rod in the heatable unit; and re-inserting the re-heated heatable rod into one of the roller shells in the hair.

28. The method of claim 19, further comprising waiting for the hair to finish curling before removing the heatable rod from the roller shell; and leaving the roller shell in the hair until the hair is styled.

* * * * *